US007982573B2

(12) United States Patent
Mori

(10) Patent No.: US 7,982,573 B2
(45) Date of Patent: Jul. 19, 2011

(54) COIL DEVICE

(76) Inventor: Ryutaro Mori, Saitama (JP)

( * ) Notice: Subject to any disclaimer, the term of this patent is extended or adjusted under 35 U.S.C. 154(b) by 0 days.

(21) Appl. No.: 12/516,409

(22) PCT Filed: Nov. 29, 2007

(86) PCT No.: PCT/JP2007/073077

§ 371 (c)(1),
(2), (4) Date: Mar. 29, 2010

(87) PCT Pub. No.: WO2008/069098

PCT Pub. Date: Jun. 12, 2008

(65) Prior Publication Data

US 2010/0176908 A1 Jul. 15, 2010

(30) Foreign Application Priority Data

Nov. 29, 2006 (WO) ..... PCT/JP2006/323788

(51) Int. Cl.
*H01F 5/00* (2006.01)

(52) U.S. Cl. ..... 336/200; 336/223; 336/232

(58) Field of Classification Search ..... None
See application file for complete search history.

(56) References Cited

U.S. PATENT DOCUMENTS

| | | | | |
|---|---|---|---|---|
| 5,552,756 | A | 9/1996 | Ushiro | 336/200 |
| 6,587,025 | B2 * | 7/2003 | Smith et al. | 336/200 |
| 7,049,924 | B2 * | 5/2006 | Hayashi et al. | 336/200 |
| 7,446,632 | B2 * | 11/2008 | Tomonari et al. | 333/185 |
| 2010/0141369 | A1 | 6/2010 | Mori | 336/200 |

FOREIGN PATENT DOCUMENTS

| | | | |
|---|---|---|---|
| JP | 05-258961 | A | 10/1993 |
| JP | 06-084647 | A | 3/1994 |
| JP | 06-215949 | A | 8/1994 |
| JP | 2005-012071 | A | 1/2005 |
| WO | 2007/063884 | A1 | 6/2007 |

* cited by examiner

*Primary Examiner* — Anh T Mai
(74) *Attorney, Agent, or Firm* — Ladas & Parry, LLP

(57) ABSTRACT

A coil device is provided which has a small loss in a high-frequency band even if it has an air core or a core material used is not of so high quality when it has a core, generates little magnetic extraneous radiation, has a stable frequency characteristic of an inductance, and can be manufactured at low cost. What is formed by winding a linear conductor around two axes which are parallel with each other to be in a substantially S-shape as a whole by one turn with winding directions made different is set as one layer of unit winding, the unit windings are stacked in a plurality of layers while aligning the axes, and the unit windings of all layers are electrically connected in series.

18 Claims, 12 Drawing Sheets

(a) top view (b) vertical sectional view (a) two rings configuring unit winding (b) core section (a) application example to compound-wound transformer (example 1)

(b) application example to compound-wound transformer (example 2)

(a) coil device for comparison (b) coil device of embodiment

COIL DEVICE

TECHNICAL FIELD

The invention relates to a coil device used as an inductor element, a power transfer element, a transformer or the like, and particularly relates to a coil device preferable for high frequency use.

BACKGROUND ART

Recently, in the field of a computer, communication equipment and the like, development of an inductor, a transformer and a coil have been desired, which are suitable for high frequency use (for example, 100 KHz to several hundreds GHz).

In development of the inductor, power transformer and coil, the technical problems of how to decrease the loss in a high frequency band, how to decrease extraneous magnetic radiation, how to stabilize the frequency characteristic of the inductance, and how to enable low-cost production and the like have to be solved.

Conventionally, in order to reduce the loss in a high frequency band, in inductances, transformers and coils of this kind, importance has tended to be placed on development of core materials with high quality which satisfy various performances (for example, low hysteresis loss, and the like) required of the cores (for example, see Patent Document 1).

Further, in order to reduce extraneous magnetic radiation in the inductances, transformers and coils of this kind, the device which pays attention to the shapes of the core and winding has been made (for example, see Patent Document 2).

[Patent Document 1] Japanese Patent Laid-Open No. 2001-237136

[Patent Document 2] Japanese Patent Laid-Open No. 2004-172517

DISCLOSURE OF THE INVENTION

Problems to be Solved by the Invention

However, the coil device using the core material with high quality which satisfies various performances (for example, low hysteresis loss and the like) required of the core has the problem that producing the coil device at a low cost is difficult, and the coil device which focuses attention on the shapes of the core and winding has the problem of being unable to reduce extraneous radiation sufficiently.

The invention is made in view of the aforementioned problems, and an object of the invention is to provide a coil device which has a small loss in a high-frequency band even if the coil device has an air core, or a core material used is not of so high quality when the coil device has a core, generates little magnetic extraneous radiation, has a stable frequency characteristic of an inductance, and can be manufactured at low cost.

Other objects and operational effects of the invention would be easily understood by a person skilled in the art by referring to the following account of the description.

Means for Solving the Problem

The aforementioned technical problems are considered to be solved by the coil device having the following configuration.

More specifically, a coil device of the present invention is such that what is formed by winding a linear conductor around two axes, which are parallel with each other, to be in a substantially S-shape as a whole by one turn with winding directions made different is set as one layer of unit winding, the unit windings are stacked in a plurality of layers while aligning the axes, and the unit windings of all layers are electrically connected in series.

According to such a configuration, a magnetic push-pull operation is performed in each unit winding of each of the layers, and even if the device has an air core, or even if a core material used is not of so high quality when the device has a core, the coil device has a small loss in the high-frequency band, generates little magnetic extraneous radiation, has a stable frequency characteristic of the inductance, and can be manufactured at low cost.

According to a preferred embodiment, two rings configuring the unit winding of each of the layers are formed into same shapes, the two rings share one linear side, and the linear side is located on a perpendicular bisector of a straight line connecting both the axes.

According to such a configuration, the linear side shared by the two rings is located on the perpendicular bisector of the line segment connecting both the axes. Therefore, the magnetic flux which generates from the unit winding of each of the layers is efficiently added, and thereby, the aforementioned operational effect is promoted.

According to a preferred embodiment, the two rings are configured by two regular triangles sharing a bottom side, and a tip end of each vertex of inner perimeters and outer perimeters of the regular triangles is cut into a linear shape so that all interior angles become 120 degrees.

According to such a configuration, the linear side shared by the two regular triangles is located on the perpendicular bisector of the line segment connecting both the axes. Therefore, the magnetic flux which generates from the unit winding of each of the layers is added more efficiently, and heat generation by a high-frequency current in the vertexes of the regular triangles is reduced. Therefore, the aforementioned operational effect is further promoted.

According to a preferred embodiment, the unit winding of each of the layers is formed by one conductive wire common to all the layers.

According to such a configuration, the wire-wound type coil device can be provided, which has a small loss in a high-frequency band even if the coil device has an air core, or even if the core material used is not of so high quality when the coil device has a core, generates little magnetic extraneous radiation, has a stable frequency characteristic of the inductance, and can be manufactured at low cost.

According to a preferred embodiment, the unit winding of each of the layers is formed by using a multilayer wiring substrate manufacturing technique.

According to such a configuration, the low-profile coil device by stacked substrates can be provided, which has a small loss in a high-frequency band even if the coil device has an air core, or even if the core material used is not of so high quality when the coil device has a core, generates little magnetic extraneous radiation, has a stable frequency characteristic of the inductance, and can be manufactured at low cost.

More specifically, if the S-shaped pattern is adopted as the pattern of each layer, the patterns in the upper and lower layers are completely superimposed, in addition to which, if the multilayered substrate manufacturing technique is adopted, superimposition of the misaligned upper and lower wires due to twist and bending of the wire as in the case of using a conductive wire is eliminated, uniformization of the parasitic capacitance among the linear conductors is promoted, and product efficiency is improved.

In addition, when the two rings configuring the S-shaped coil are configured by separate individual windings, four vias for connecting the upper and lower layers are required for each layer, whereas according to the S-shaped pattern of the present invention, two vias for interlayer connection are required for each layer, and the number of expensive vias can be reduced by one-half, whereby the manufacture cost can be significantly reduced.

According to a preferred embodiment, the unit winding of each of the layers is formed by using a semiconductor integrated circuit manufacturing technique.

According to such a configuration, the semiconductor-embedded type coil device can be provided, which has a small loss in a high-frequency band even if the coil device has an air core, or even if the core material used is not of so high quality when the coil device has a core, generates little magnetic extraneous radiation, has a stable frequency characteristic of an inductance, and can be manufactured at low cost.

More specifically, if the S-shaped pattern is adopted as the pattern of each layer, the patterns in the upper and lower layers are completely superimposed, in addition to which, if the semiconductor integrated circuit manufacturing technique is adopted, superimposition of the misaligned upper and lower wires due to twist and bending of the wire as in the case of using a conductive wire is eliminated, uniformization of the parasitic capacitance among the linear conductors is promoted, electronic transfer is performed more smoothly in the semiconductor chip, and product efficiency is further improved with these things being combined.

According to a preferred embodiment, the coil device is used as a winding of a single-wound transformer, or as each of windings of a compound-wound transformer.

According to such a configuration, the single-wound transformer or the compound-wound transformer can be provided, which has a small loss in a high-frequency band even if the coil device has an air core, or even if the core material used is not of so high quality when the coil device has a core, generates little magnetic extraneous radiation, has a stable frequency characteristic of the inductance, and can be manufactured at low cost.

Advantage of the Invention

According to the present invention, a magnetic push-pull operation is performed in each unit winding of each of the layers, and therefore, the coil device can be provided, which has a small loss in a high-frequency band even if the coil device has an air core, or even if the core material used is not of so high quality when the coil device has a core, generates little magnetic extraneous radiation, has a stable frequency characteristic of an inductance, and can be manufactured at low cost.

BEST MODE FOR CARRYING OUT THE INVENTION

Hereinafter, one mode of a preferred embodiment of the coil device according to the invention will be described in detail with reference to the attached drawings.

A schematic configuration view of the coil device (using a conductive wire) according to the present invention is shown in FIG. 1. As shown in the drawing, a coil device 1 is configured in such a manner that what is formed by winding a conductive wire (for example, an enameled wire, a litz wire or the like) c around two axes Z1 and Z2 which are parallel with each other to be in a substantially S-shape as a whole by one turn with the winding directions around the axes made different from each other to be counterclockwise and clockwise is set as a unit winding W of one layer, and these unit windings W are stacked in a plurality of layers while aligning the axes Z1 and Z2, and are disposed so that the unit windings of all layers are electrically connected in series.

In the drawing, those assigned with reference numerals and characters W1, W2, W3, . . . Wn are the unit windings of the first layer, the second layer, the third layer . . . the $n^{th}$ layer. The respective unit windings W1, W2, W3 . . . Wn are configured by first rings a1, a2, a3 . . . an which are each wound counterclockwise by one turn, and second rings b1, b2, b3 . . . bn each wound clockwise by one turn.

More specifically, the unit winding W1 of the first layer is configured by the first ring a1 which is wound around the linear axis Z1 counterclockwise by one turn, and the second ring b1 which is wound around the linear axis Z2 clockwise by one turn. Similarly, the unit winding W2 of the second layer is configured by the first ring a2 which is wound around the axis Z1 counterclockwise by one turn, and the second ring b2 which is wound around the axis Z2 clockwise by one turn. The following unit winding W3 of the third layer to unit winding Wn of the $n^{th}$ layer are similarly configured.

A winding start end of the conductive wire c is led out to a first coil terminal T1, and a winding tail end is led out to a second coil terminal T2.

Note that the coil device 1 shown in the solid view of FIG. 1 (*a*) is illustrated in abbreviated form as shown in the schematic view of FIG. 1 (*b*) for convenience of explanation in accordance with necessity.

An explanatory view of an essential part of the coil device (using a conductive wire) shown in FIG. 1 is shown in FIG. 2. As shown in a top view of FIG. 2 (*a*), in this example, the first ring a1 and the second ring b2 are each formed into a substantially complete round shape, and as shown in a vertical sectional view of FIG. 2 (*b*), the first rings a1, a2 and a3 and the second rings b1, b2 and b3 which configure the unit windings W1, W2 and W3 of the respective layers have one common portions ab1, ab2 and ab3. In this example, the common portions ab1, ab2 and ab3 are each formed into one point where the wires intersect.

The first rings a1, a2, a3 . . . an and the second rings b1, b2, b3 . . . bn which configure the respective unit windings W1, W2, W3 . . . Wn are formed into the same shapes (the complete round shapes with the same radiuses in this example). Therefore, when they are superimposed vertically by aligning the axes Z1 and Z2, the common portions ab1, ab2, ab3 . . . abn of the respective unit windings W1, W2, W3 . . . Wn are aligned in line in the direction along the axis (vertical direction in this example).

Therefore, a magnetic flux $\phi$ which generates by the current flowing in each of the unit windings W1, W2, W3 . . . Wn of the respective layers generates upward or downward in the axis Z1 and downward or upward in the axis Z2 with a phase difference of 180° from each other without cancelling off each other, and thereby, a high-frequency voltage is applied, whereby, a magnetic push-pull operation is performed between the first axis Z1 and the second axis Z2.

As a result, as is obvious from the experiment result (see FIG. 9) which will be described later, according to the coil device 1 using the conductive wire shown in FIG. 1, the practical effect of having a small loss in a high-frequency band even if the coil device has an air core, or the core material used is not of so high quality when the coil device has a core, generating little magnetic extraneous radiation, having a stable frequency characteristic of the inductance, being able to be manufactured at low cost, and the like can be obtained.

An explanatory view of a more concrete embodiment of the coil device (using a conductive wire) is shown in FIG. 3. As shown in the drawing, a coil device 10 is configured by accommodating a coil assembly 13 in a coil case 11.

The coil case 11 can be formed by using a magnetic material such as ferrite, or a nonmagnetic material such as ceramics or plastic, and a void space 12 is provided in an inside thereof. A first columnar core 15 and a second columnar core 16 having predetermined sectional shapes respectively are integrally formed in the void space 12. When the coil case 11 is made of ferrite, the first columnar core 15 and the second columnar core 16 are also formed integrally from ferrite. When the case is made of plastic or ceramics, the columnar cores 15 and 16 are also integrally formed from plastic or ceramics.

The coil assembly 13 is formed by winding the conductive wire c around hollow bobbins 15' and 16' formed on a mounting board 14 of plastic. The coil assembly 13 is accommodated in the coil case 11 by being put on the columnar cores 15 and 16 in the coil case 11 after the winding work is performed outside the case.

More specifically, the coil assembly 13 is configured by setting as a unit winding of one layer what is formed by winding the conductive wire c around the two bobbins 15' and 16' to be in a substantially S-shape as a whole by one turn with the winding directions made different from each other, stacking the unit windings in a plurality of layers while aligning the axes, and disposing the units windings so that the unit windings of all layers are electrically connected in series.

The coil assembly 13 thus completed is returned into the void space 12 in the coil case 11 again as shown by the arrow A2 in the drawing, and is accommodated and fixed in the coil case 11 by a known technique such as use of an adhesive, resin sealing and the like.

An explanatory view of an essential part in one embodiment of FIG. 3 is shown in FIG. 4. As shown in the drawing, the first and the second columnar cores 15 and 16 or bobbins 15' and 16' are opposed with a clearance corresponding to the thickness of the wire c therebetween, and their sectional shapes are irregular hexagons. In more detail, the section of each of them is basically formed into a regular triangle, and the respective three vertexes are cut orthogonally to the axis, whereby the section is formed into an irregular hexagonal section in which all the interior angles are 120° (see FIG. 4(*b*)).

The conductive wire c is wound around the first and the second columnar cores 15 and 16 each having such an irregular hexagonal section into a substantially S-shape, and thereby, the shapes of the two rings a1 and b1 configuring the unit winding W1 are two substantially regular triangles sharing the bottom side, as shown in FIG. 4 (*a*).

At this time, the sections of the first and the second columnar cores 15 and 16 or the bobbins 15' and 16' around which the wire c is wound are irregular hexagonal as described above, and therefore, the rings a1 and b1 which are produced by being wound around them are in regular triangles as a whole, but are in the shape which are bent at an interior angle of 120° in each of the vertexes.

In other words, the two rings (a1 to an, b1 to bn) configuring the unit windings W1 to Wn of the respective layers are each formed into a substantially regular triangle, the two rings a1 and b1 share the common portion ab1 to be one linear side, and the common portion ab1 to be the linear side is located on the perpendicular bisector of the line segment connecting both the axes Z1 and Z2. In addition, the two rings a1 and b1 are configured by the two regular triangles sharing the bottom side, and the tip end of each of the vertexes of the inner perimeters and the outer perimeters of the regular triangles are cut into a linear shape so that all the interior angles become 120°.

By having such a configuration, according to the embodiment of the coil device shown in FIG. 3, as compared with the case where the two rings a1 and b1 are in other polygonal shapes (for example, a quadrangle, a hexagon, an octagon, and the like), the magnetic flux concentration efficiency in the axes Z1 and Z2 is the highest, and all the interior angles of the two rings a1 and b1 configuring the unit winding of each layer are 120°. Therefore, the advantage is obtained, that heat generation in each of the vertexes is hardly caused even by passage of a high-frequency current and a loss is small.

As a result, according to the coil devices of the embodiment shown in FIGS. 3 and 4, the advantages are obtained, that even if the core material used is not of so high quality, a loss in the high-frequency band is small, little magnetic extraneous radiation is generated, and the frequency characteristic of the inductance is stable.

The application example of the coil device (using the conductive wire) according to the present invention to a compound-wound transformer is shown in FIG. 5. As the coil expression in the drawing, the abbreviation method described above with reference to FIG. 1(*b*) is adopted.

The application example (example 1) to the compound-wound transformer shown in FIG. 1(*a*) is configured by providing two or more of the coil devices described above, and disposing them by dispersing them in the axial direction. In this example, the first coil device is configured by disposing first rings a11, a12, a13 and a14 and second rings b11, b12, b13 and b14 between a pair of coil terminals T11 and T12. Further, the second coil device is configured by connecting first rings a21, a22 and a23, and second rings b21, b22 and b23 between a pair of coil terminals T21 and T22. For example, the first coil device becomes a primary winding of the transformer, and the second coil device becomes a secondary winding of the transformer.

FIG. 5 (*b*) shows an application example (example 2) to a compound-wound transformer. In this example, as the conductive wire, a multi-core wire including two or more core wires insulated from each other is used, and the compound-wound transformer is configured by winding this in an S-shape between the first axis Z1 and the second axis Z2. More specifically, the first coil device is configured by connecting first rings a31, a32, a33 and a34, and second rings b31, b32, b33 and b34 between a pair of coil terminals T31 and T32. The second coil device is configured by connecting first rings a41, a42, a43 and a44 and second rings b41, b42, b43 and b44 between a pair of external terminals T41 and T42. For example, the first coil device becomes a primary winding of the transformer, and the second coil device becomes a secondary winding of the transformer.

In the example of FIG. 5, only the case of the compound-wound transformer is described, but a person skilled in the art would easily understand that a single-wound transformer can be configured if a center tap is derived from a midpoint of the first coil device.

A more concrete embodiment of application of the coil device (using a conductive wire) to a compound-wound transformer is shown in FIG. 6. A compound-wound transformer 20 which is illustrated in the drawing is configured by combining two coil devices 10A and 10B. The structures of these coil devices 10A and 10B are the same as that of the coil device 10 which is described with reference to FIG. 3 and FIG. 4.

More specifically, the coil device 10A is configured by accommodating and fixing a coil assembly 13A in a void space 12A of a coil case 11A, and the coil device 10B is configured by accommodating and fixing a coil assembly 13B in a void space 12B of a case 11B. These coil devices 10A and 10B are opposed so as to bring columnar cores 15A and 16A and columnar cores 15B and 16B into a state in which they are butted to each other, and both the cases 11A and 11B are connected to face each other, whereby the compound-wound transformer 20 having the coil arrangement shown in FIG. 5 (*a*) is completed. Reference numerals and characters 15A', 16A', 15B' and 16B' designate bobbins.

By this compound-wound transformer, a magnetic push-pull operation is also efficiently performed while the magnetic flux is concentrated with high density, and therefore, the advantages are obtained, that even if a core material of so high quality is not used, a loss in a high frequency band is small, little magnetic extraneous radiation is generated, and the frequency characteristic of the inductance is stable.

Next, a configuration view of one embodiment of the coil device (multilayer wiring substrate manufacturing technique) is shown in FIG. 7. As shown in the drawing, a coil device 30 is configured by stacking seven wiring substrates, that is, a first layer substrate 31-1, a second layer substrate 31-2, a third layer substrate 31-3, a fourth layer substrate 31-4, a fifth layer substrate 31-5, a sixth layer substrate 31-6 and a seventh layer substrate 31-7, and further stacking a first power supply layer 32 and an insulating coating layer 34 on a top surface side thereof while stacking a second power supply layer 33 and an insulating coating layer 35 on an undersurface side.

Two cylindrical cores 37*a* and 37*b* parallel with each other are inserted through and fixed to the substrate layered stack. These cylindrical cores 37*a* and 37*b* are formed by using a magnetic material (for example, ferrite or the like), the sections thereof are each formed into a substantially regular triangle, and are positioned in the orientation in which one bottom sides are parallel with each other, that is, in the orientation in which the two regular triangles are back to back via the bottom sides.

The conductive thin film (for example, a copper foil or an aluminum foil) of the first layer substrate 31-1 remains in a substantially solid state (entirely uniform) except for the portions of a first magnetic flux transmission hole 36*a* and a second magnetic flux transmission hole 36*b* corresponding to the axis positions of the cylindrical cores 37*a* and 37*b*, and this functions as the first power supply layer 32.

The conductive thin film of each of the second layer substrate 31-2 to the seventh layer substrate 31-7 is formed as a substantially S-shaped conductor (for example, a copper foil or an aluminum foil) pattern corresponding to a unit winding by etching processing.

In the upper space of the section of the layer stack in the drawing, an S-shaped conductor pattern corresponding to the unit winding W1 of the first layer is drawn. As is obvious from the drawing, the S-shaped conductor pattern corresponding to the unit winding W1 of the first layer has the first ring a1 which is formed by winding the linear conductor counter-clockwise around the first cylindrical core 37*a* by one turn, and the second ring b1 which is formed by similarly winding the linear conductor clockwise around the second cylindrical core 37*b* by one turn. The two rings a1 and b1 each have a regular triangle shape, and shares a bottom side of each other, and thereby, the linear common portion ab1 is formed. The linear common portion ab1 is disposed to be located on the perpendicular bisector of the line segment connecting the axes of the two cylindrical cores 37*a* and 37*b*.

Naturally, in this example, the device is also performed to make all the interior angles 120° for the corner portions of the conductor pattern corresponding to the respective vertexes of the regular triangle in order to suppress overheating due to passage of a high-frequency current.

The S-shaped conductor patterns corresponding to the unit windings formed on the respective second layer substrate 31-2 to the seventh layer substrate 31-7 are connected by known interlayer connecting means (a via 38 is used in this example), and thereby, the unit windings W1 to W6 of the respective layers are brought into the state electrically connected in series in sequence from the top.

As a result, when seen as a whole, the coil device 30 has the structure in which what is formed by winding the linear conductor around two axes which are parallel with each other to be in a substantially S-shape as a whole with the winding directions made different from each other by one turn is set as a unit winding of one layer, the unit windings are stacked in a plurality of layers while aligning the axes, and the unit windings of all layers are electrically connected in series.

Therefore, according to the coil device 30 having such a structure, a low-profile type coil device by stacked substrates can be realized, which has a small loss in a high-frequency band even if the coil device has an air core or a core material used is not of so high quality when the device has a core, generates little magnetic extraneous radiation, has a stable frequency characteristic of the inductance, and can be manufactured at low cost.

The wire winding type coil device, and a low-profile type coil device by the stacked substrates are described above, but a person skilled in the art would easily understand that the coil device of the present invention can also be realized as a semiconductor-embedded type coil device by using the semiconductor integrated circuit manufacturing technique for the similar structure.

Finally, the performance test result of the coil device according to the present invention will be described. An explanatory view of a coil device under test is shown in FIG. 8. For verification of the coil of the present invention, a coil device for comparison shown in FIG. 8 (*a*) and an embodiment coil device shown in FIG. 8 (*b*) were prepared.

As the structure around which the linear conductor should be wound, what was formed by connecting both ends of the two columnar cores, which are parallel with each other, with yokes, and fixing them with a rubber ring was adopted. At this time, the two columnar cores of ferrite, each with a diameter of 12 mm and a length of 50 mm were used. Meanwhile, as the conductive wire to be wound around these columnar cores, an enameled wire with a diameter of 0.7 mm and an enamel coating thickness of 2 μm was used.

The one formed by winding the conductor wire around only one core out of the two columnar cores spirally by 36 turns was used as the coil device for comparison as shown in FIG. 8 (*a*), whereas the one formed by winding the conductive wire around both the columnar cores alternately in the opposite directions by one turn, and winding the conductive wire into the S-shape by 36 turns (18 turns by two) as a whole was used as the embodiment coil device as shown in FIG. 8 (*b*). More specifically, the performances of both of them are compared in the condition that the whole lengths of the conductive wires are the same (36 turns).

A graph of FIG. 9 shows the result of measuring the frequency characteristic of the inductance by using the coil device for comparison and the embodiment coil device as above. As is obvious from the graph, in the case of the embodiment coil device, the value of the inductance abruptly decreased in the band of about 37 KHz or less, whereas in the band of 37 KHz to several tens MHz, the value of the inductance became a substantially constant value (400 μH), and it has been confirmed that stability to the frequency variation is favorable.

In contrast with this, in the case of the coil device for comparison, it has been confirmed that in the region including 37 KHz or less, the value of the inductance was comparatively stable (450 μH), but in the region exceeding this, the value of the inductance rose to show its peak at 1.5 MHz, and the value gradually decreased in the frequency band equal to or larger than this, and it became substantially zero at the region exceeding 10 MHz. For information, the example in which the linear conductor is wound by causing the winding directions to differ alternately at every three turns was tried, but it has been confirmed that as compared with the one with the winding directions caused to differ at every one turn, the frequency characteristic of the inductance significantly degraded.

Further, during the above test, when the temperatures of both the coils were compared, it was confirmed that the embodiment coil device obviously generated less heat as compared with the coil device for comparison. Further, by the different test, it was confirmed that the embodiment coil device obviously generated less extraneous radiation as compared with the coil device for comparison.

In the above embodiment, the shapes of the two rings are the same, but further testing by the present inventor et al confirmed that what is important in the present invention is that the common portions ab1, ab2, ab3 . . . are aligned in line in the stacking direction, and the shapes and the size of the two rings may be different between the left and the right. This is shown in a second and a third embodiment of FIGS. 10 to 12.

INDUSTRIAL APPLICABILITY

According to the present invention, the coil device can be provided, which has a small loss in a high-frequency band even if the coil device has an air core, or a core material used is not of so high quality when the coil device has a core, generates less magnetic extraneous radiation, has a stable frequency characteristic of the inductance, and can be manufactured at low cost.

DESCRIPTION OF SYMBOLS

Figure 1:
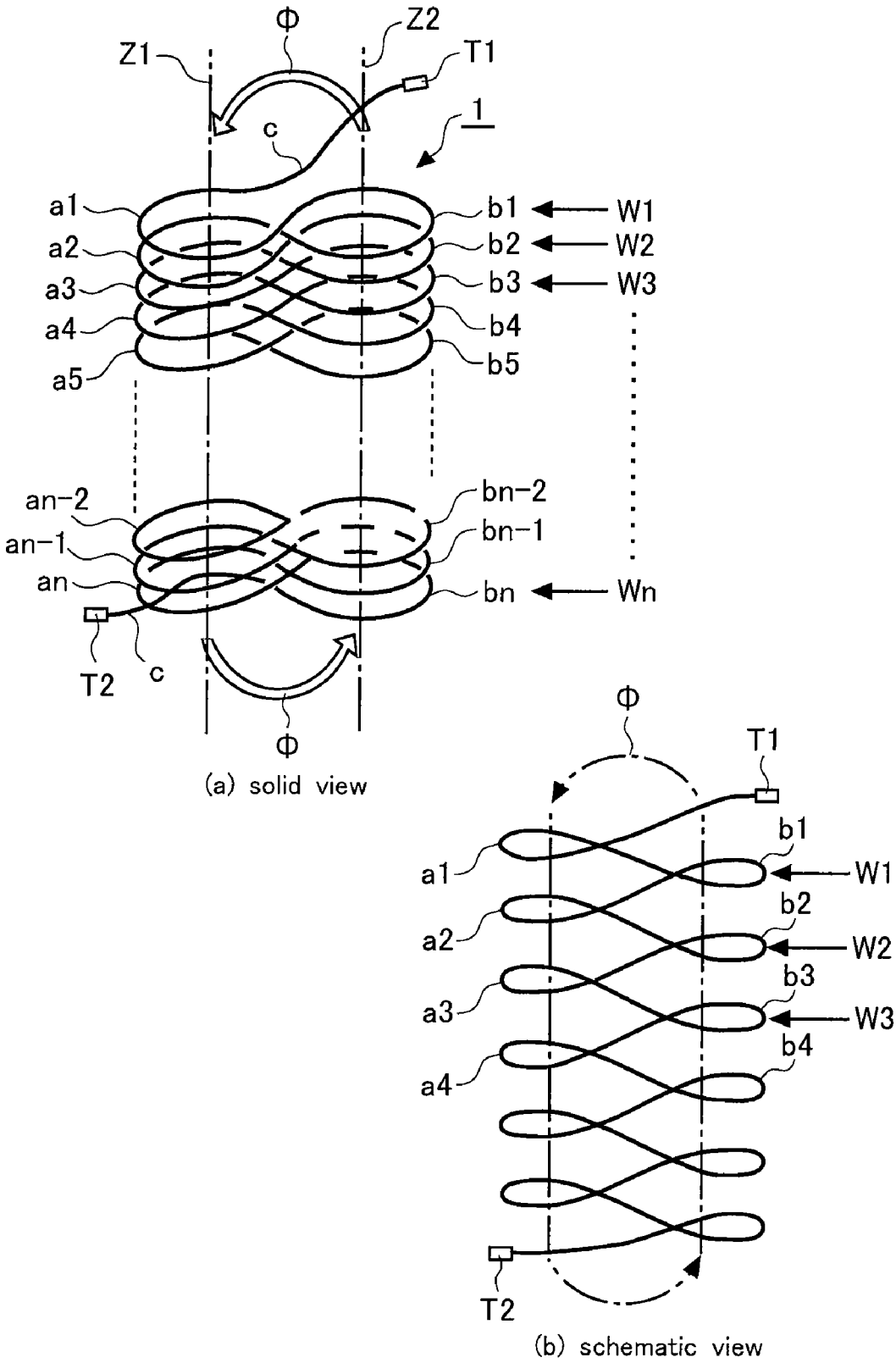
FIG. 1 is a schematic configuration view of a coil device (using a conductive wire)
Figure 2:
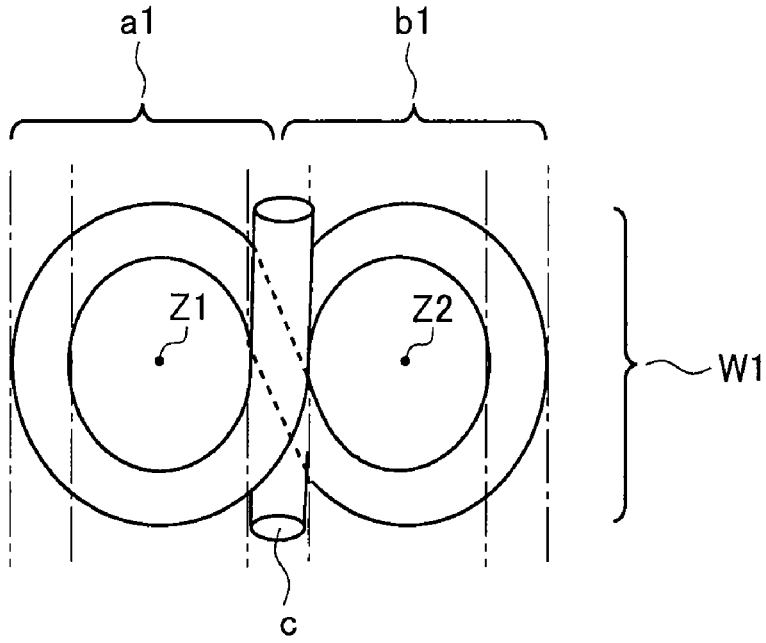
FIG. 2 is an explanatory view of an essential part of the coil device (using a conductive wire)
Figure 2:
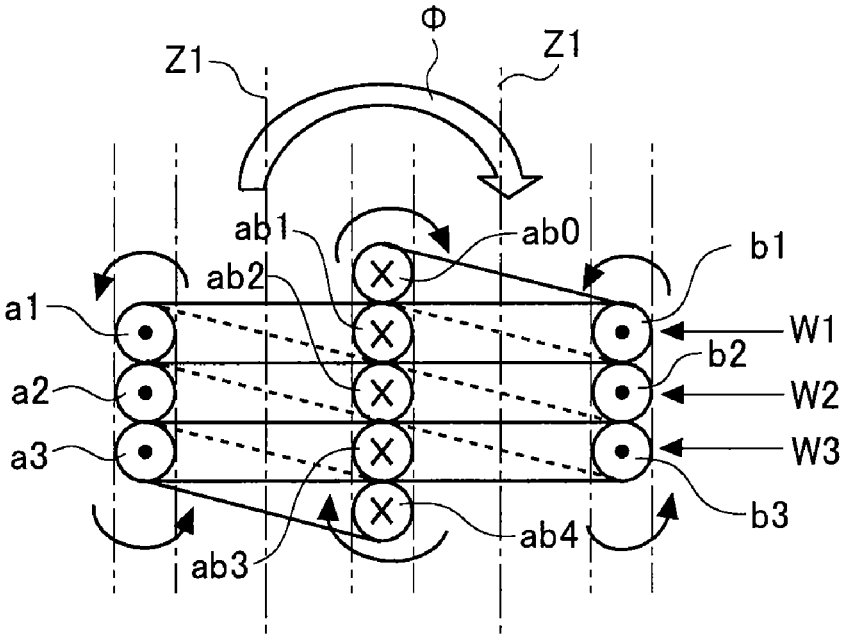
Figure 3:
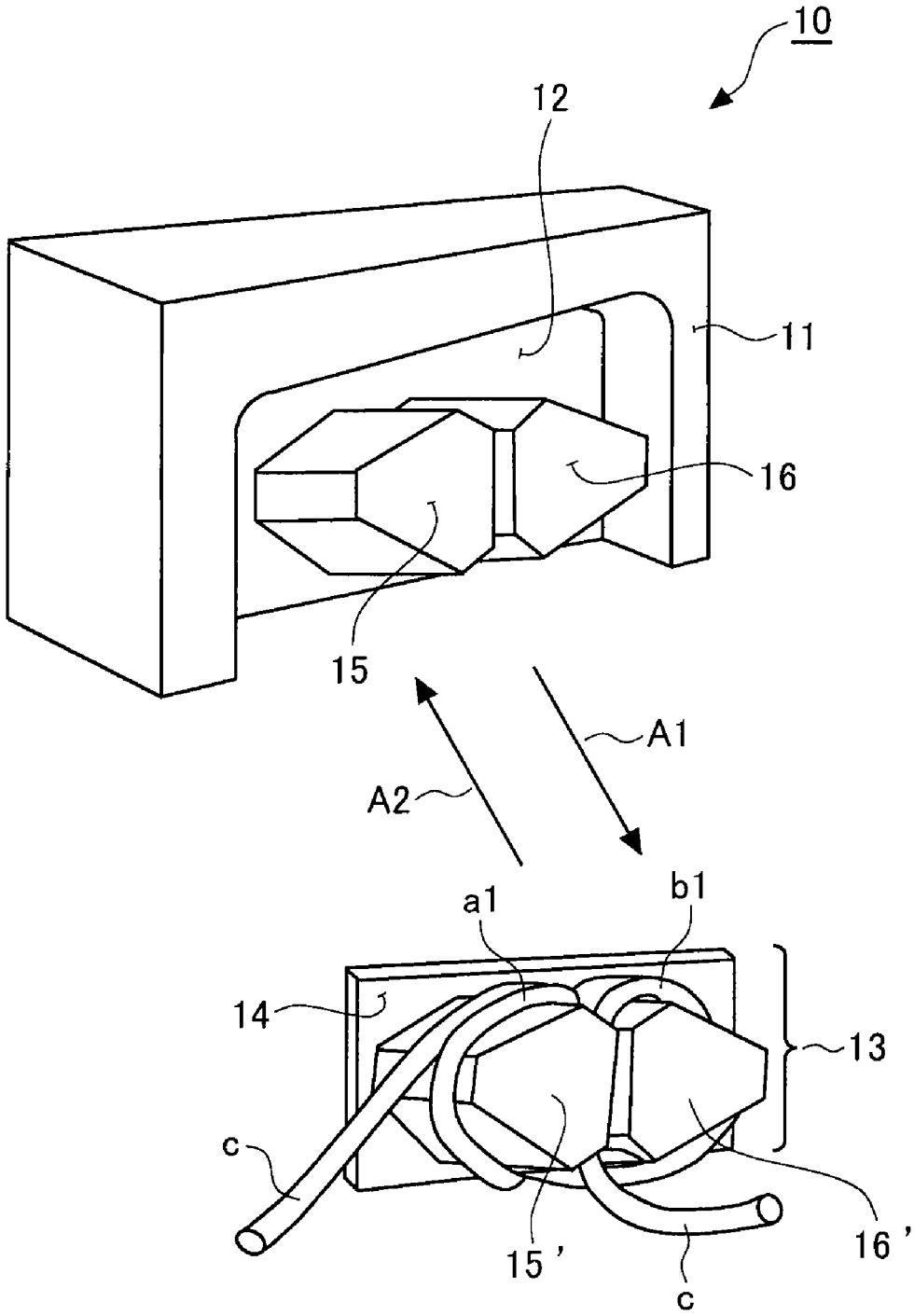
FIG. 3 is an explanatory view of one embodiment of the coil device (using a conductive wire)
Figure 4:
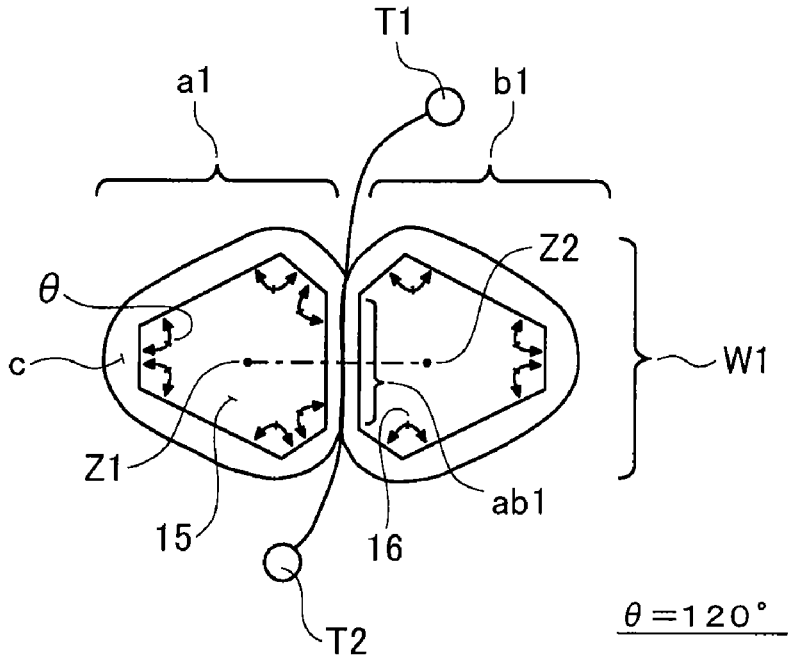
FIG. 4 is an explanatory view of an essential part in one embodiment of FIG. 3.
Figure 4:
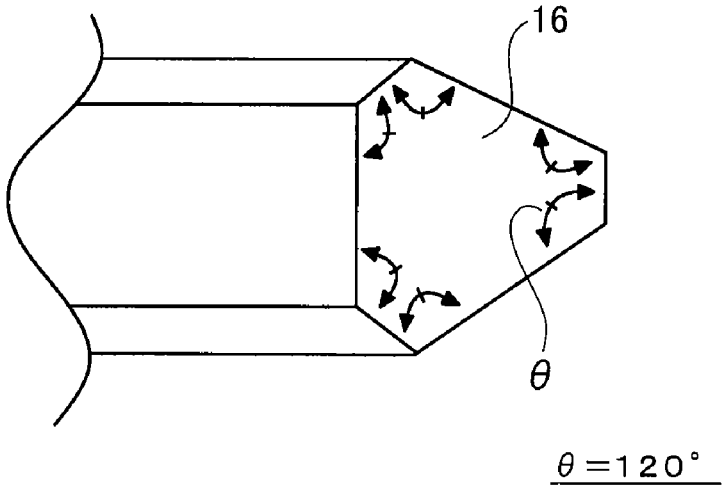
Figure 5:
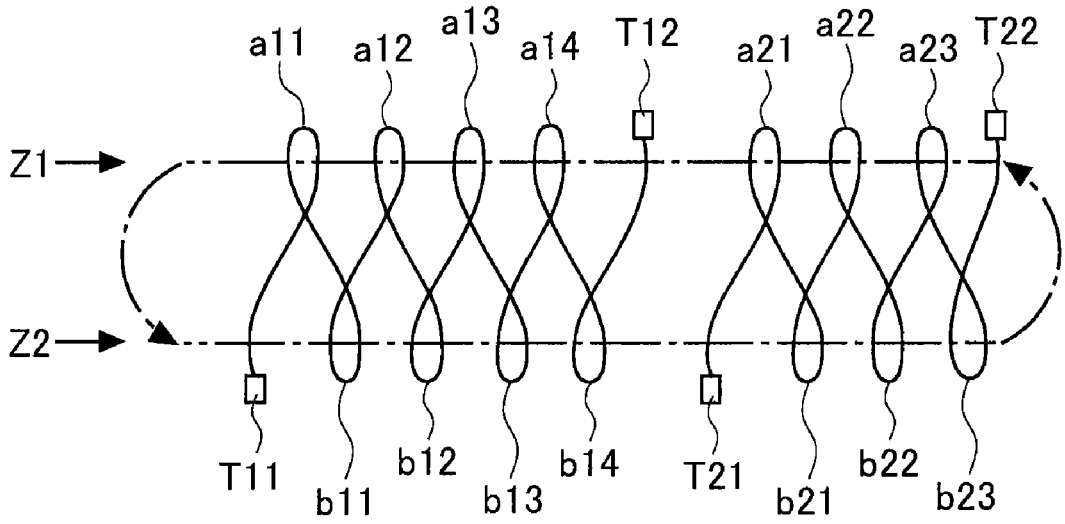
FIG. 5 is an explanatory view showing an application example of the coil device (using a conductive wire) to a compound-wound transformer.
Figure 5:
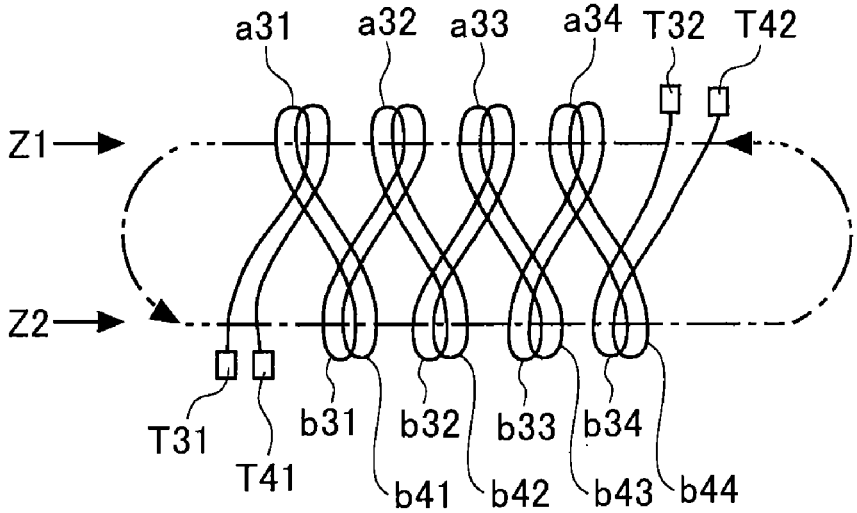
Figure 6:
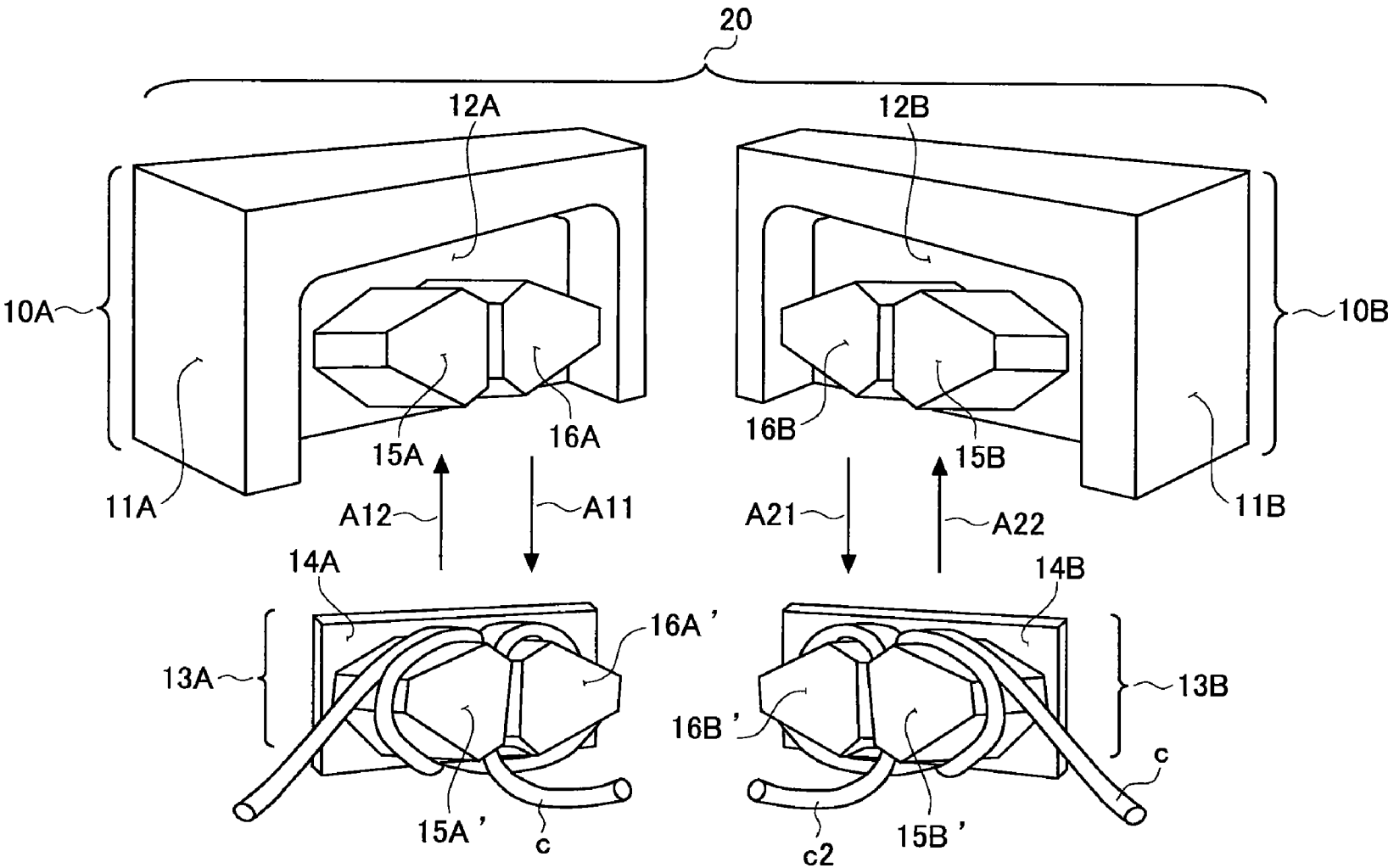
FIG. 6 is a view showing an embodiment applying to the compound-wound transformer of the coil device (using a conductive wire)
Figure 7:
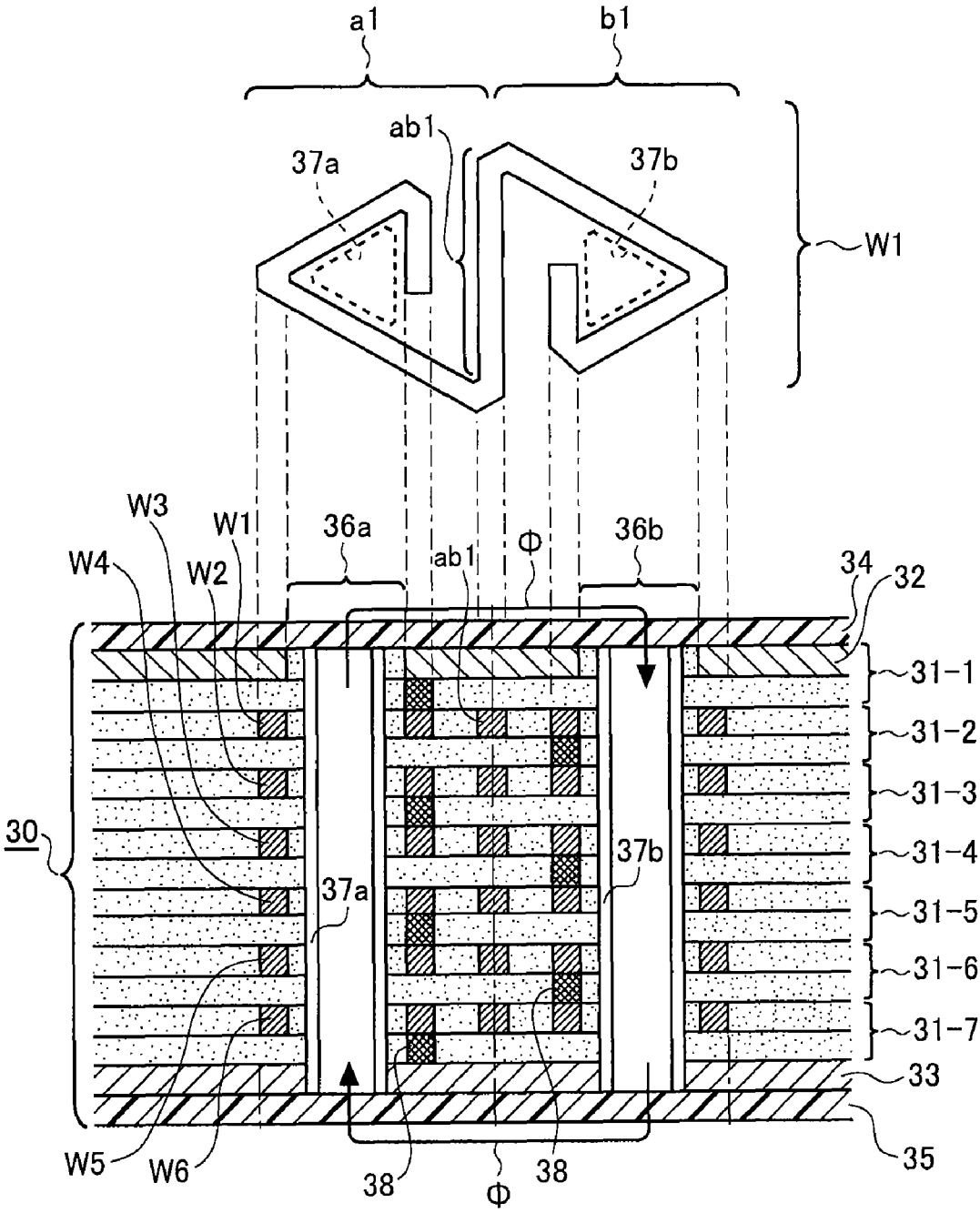
FIG. 7 is a configuration view of one embodiment of the coil device (multilayer wiring substrate manufacturing technique)
Figure 8:
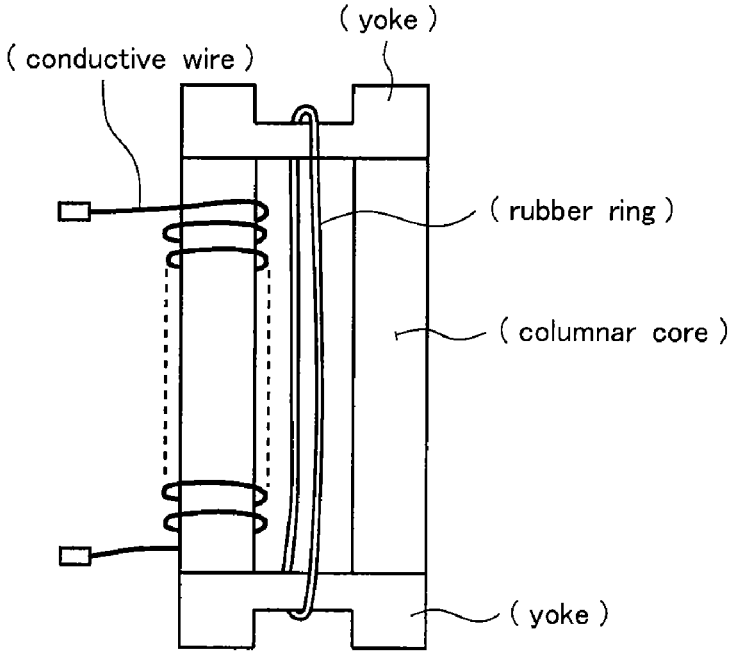
FIG. 8 is an explanatory view of a coil device under test.
Figure 8:
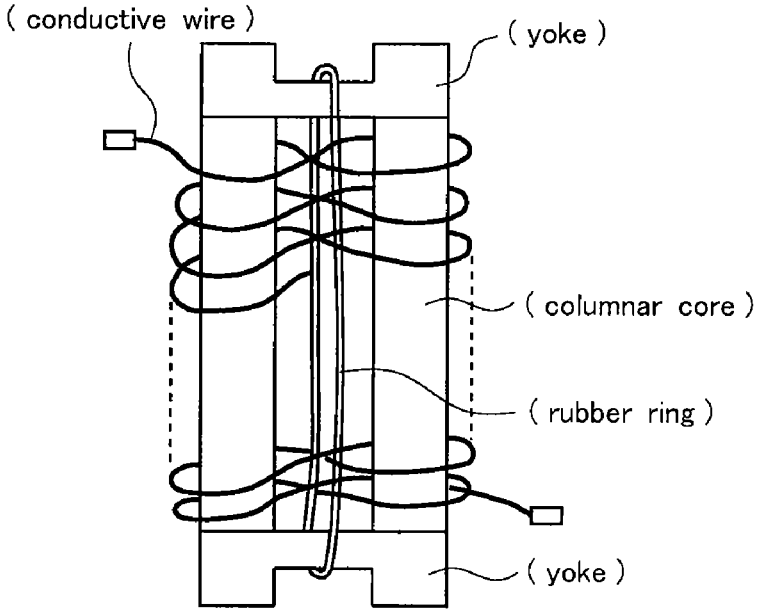
Figure 9:
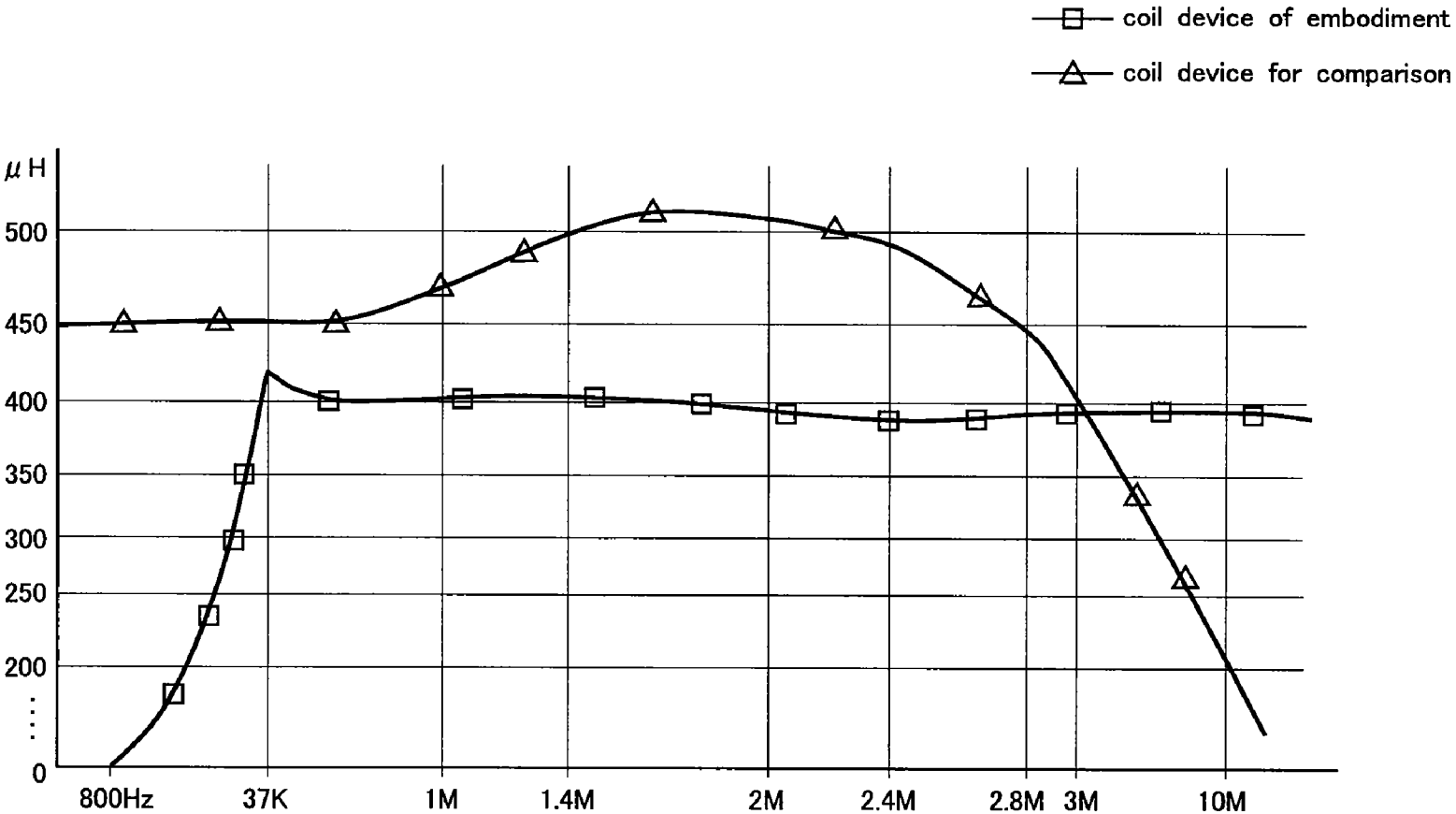
FIG. 9 is a graph showing a frequency characteristic of an inductance.
Figure 10:
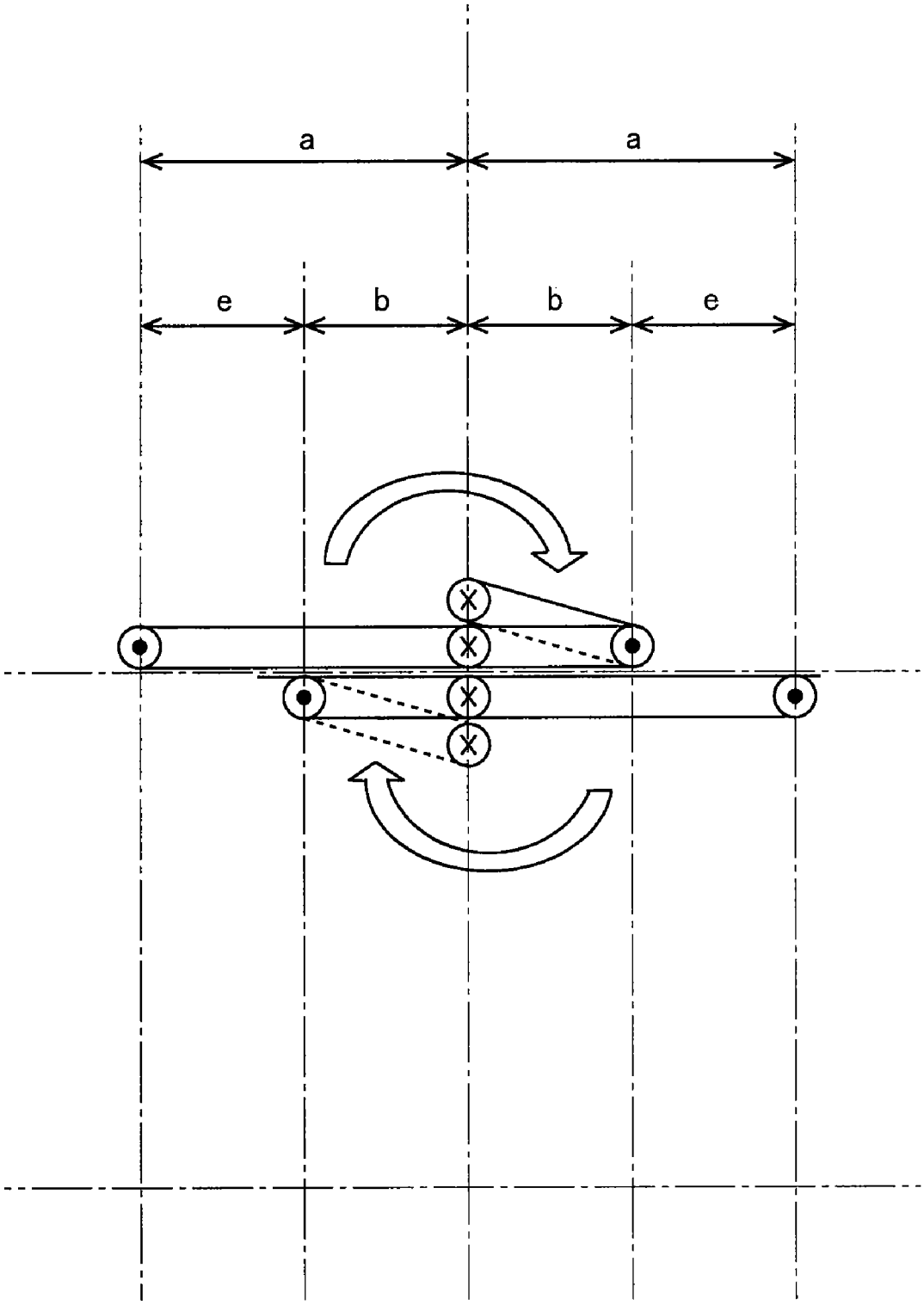
FIG. 10 is a sectional view showing a second embodiment of the coil device (using a conductive wire)
Figure 11:
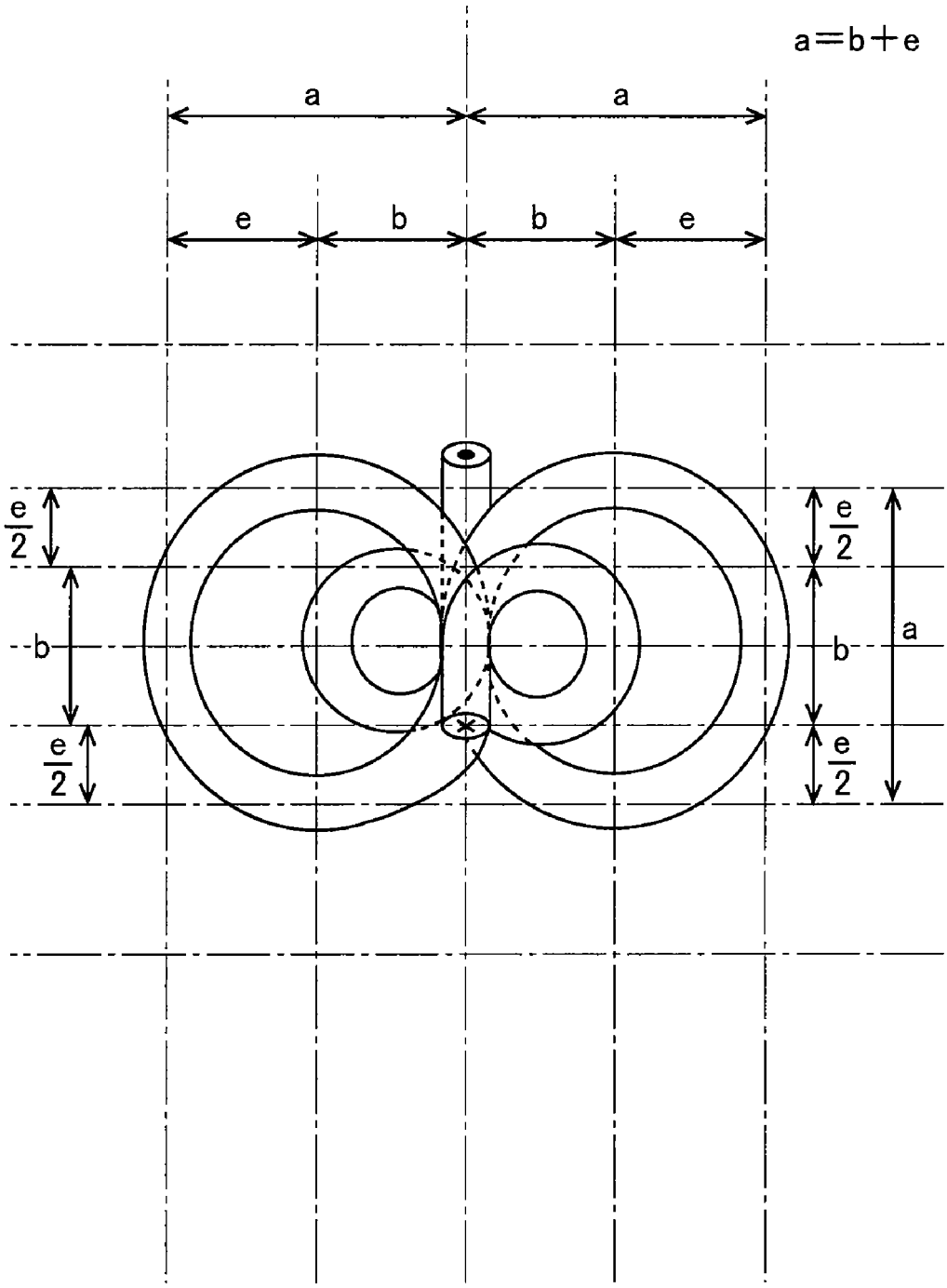
FIG. 11 is a plane view showing the second embodiment of the coil device (using a conductive wire)
Figure 12:
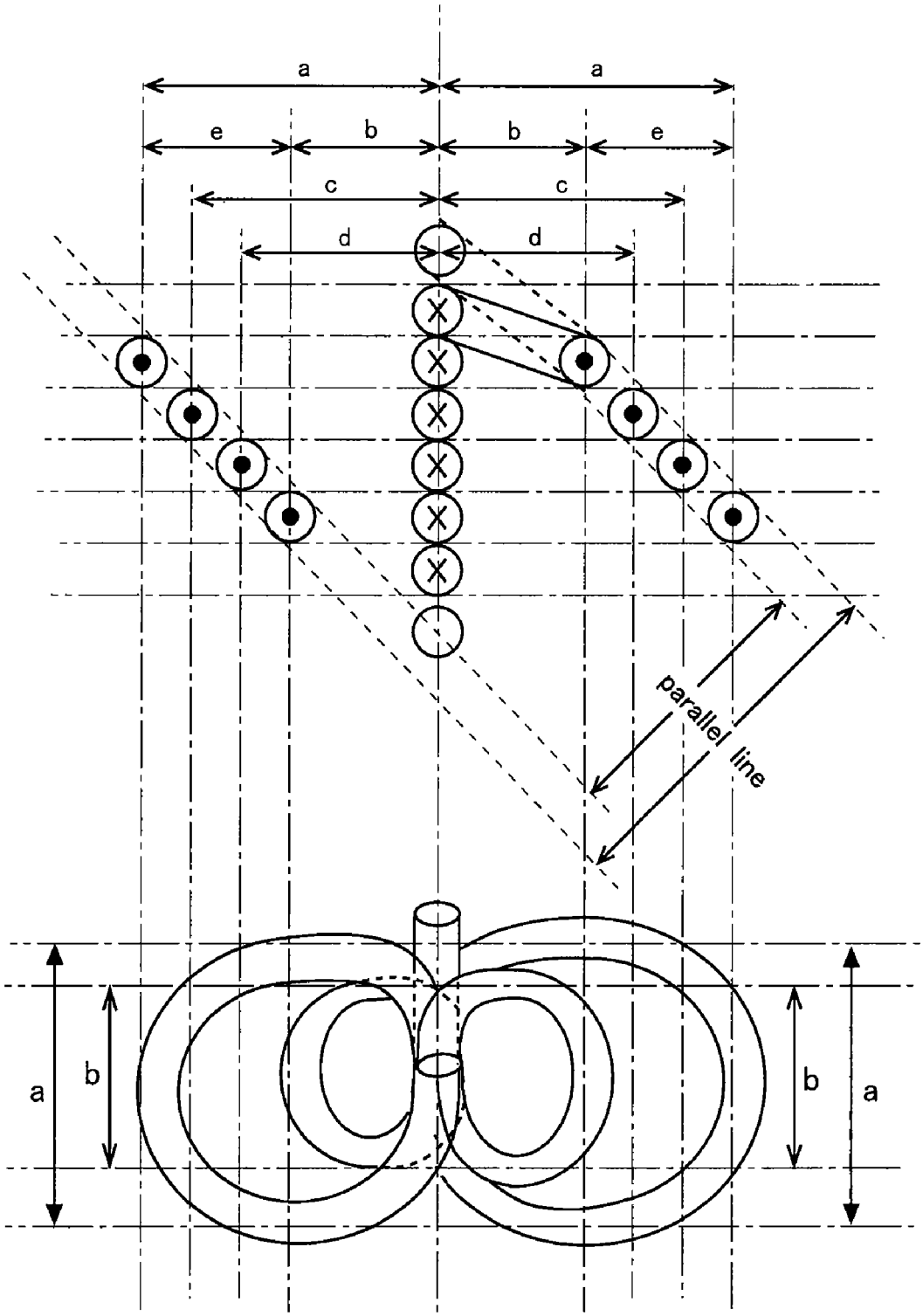
FIG. 12 is a configuration view showing a third embodiment of the coil device (using a conductive wire).

1 Coil Device
10 Coil Device
10A, 10B Coil Device
11 Coil Case
11A, 11B Coil Case
2 Void Space
12A, 12B Void Space
13 Coil Assembly
13A, 13B Coil Assembly
14 Mounting Board
14A, 14B Mounting Board
15 First Columnar Core
16 Second Columnar Core
15' Bobbin of First Columnar Core
16' Bobbin of Second Columnar Core
15A First Columnar Core
16B Second Columnar Core
15B First Columnar Core
16B Second Columnar Core
15A' Bobbin of First Columnar Core
16A' Bobbin of Second Columnar Core
15B' Bobbin of First Columnar Core
16B' Bobbin of Second Columnar Core
20 Compound-Wound Transformer
30 Coil Device
31-1 to 31-7 First Layer Substrate To Seventh Layer Substrate
32 First Power Supply Layer
33 Second Power Supply Layer
34 Insulating Coating Layer
35 Insulating Coating Layer
36*a* First Magnetic Flux Transmission Hole
36*b* Second Magnetic Flux Transmission Hole
37*a* First Cylindrical Core
37*b* Second Cylindrical Core
38 Via
Z1 First Axis
Z2 Second Axis
T1 First Coil Terminal
T2 Second Coil Terminal
W1, W2, W3 . . . Wn Unit Winding
a1, a2, a3 . . . an First Ring Configuring Unit Winding
b1, b2, b3 . . . bn Second Ring Configuring Unit Winding
ab1, ab2, ab3 Common Portion
ϕ Magnetic Flux

The invention claimed is:

1. A coil device in which what is formed by winding a linear conductor around two axes, which are parallel with each other, to be in a substantially S-shape as a whole by one turn with winding directions around the axes made different from each other is set as one layer of unit winding, the unit windings are stacked in a plurality of layers comprising two layers or more while aligning the axes, and the unit windings of all layers are electrically connected in series;

wherein two rings in the substantially S-shape configuring the unit winding of each of the layers are formed into same shapes, the two rings of each of the layers sharing one linear side, and the linear side being located on a perpendicular bisector of a line segment connecting both the axes.

2. The coil device according to claim 1, wherein the two rings configuring the unit winding of each of the layers are configured by two regular triangles sharing a bottom side.

3. The coil device according to claim 2, wherein a tip end of each vertex of inner perimeters and outer perimeters of the regular triangles is cut into a linear shape so that all interior angles of the rings are 120 degrees.

4. The coil device according to claim 2, wherein the unit winding of each of the layers is formed by one conductive wire common to all the layers.

5. The coil device according to claim 2, wherein the unit winding of each of the layers is formed by using a multilayer wiring substrate manufacturing technique.

6. The coil device according to claim 3, wherein the unit winding of each of the layers is formed by using a multilayer wiring substrate manufacturing technique.

7. The coil device according to claim 2, wherein the unit winding of each of the layers is formed by using a semiconductor integrated circuit manufacturing technique.

8. A transformer, wherein:

the transformer is a single-wound transformer in which a coil device according to claim 2 is used as a winding.

9. A transformer, wherein:

the transformer is a compound-wound transformer in which coil devices according to claim 2 are used as windings thereof.

10. The coil device according to claim 3, wherein the unit winding of each of the layers is formed by one conductive wire common to all the layers.

11. The coil device according to claim 3, wherein the unit winding of each of the layers is formed by using a semiconductor integrated circuit manufacturing technique.

12. A transformer, wherein:

the transformer is a single-wound transformer in which a coil device according to claim 3 is used as a winding.

13. A transformer, wherein:

the transformer is a compound-wound transformer in which coil devices according to claim 3 are used as windings thereof.

14. The coil device according to claim 1, wherein the unit winding of each of the layers is formed by one conductive wire common to all the layers.

15. The coil device according to claim 1, wherein the unit winding of each of the layers is formed by using a multilayer wiring substrate manufacturing technique.

16. The coil device according to claim 1, wherein the unit winding of each of the layers is formed by using a semiconductor integrated circuit manufacturing technique.

17. A transformer, wherein:

the transformer is a single-wound transformer in which a coil device according to claim 1 is used as a winding the transformer.

18. A transformer, wherein:

the transformer is a compound-wound transformer in which coil devices according to claim 1 are used as windings.

* * * * *